US009686613B2

(12) United States Patent
Lee

(10) Patent No.: US 9,686,613 B2
(45) Date of Patent: Jun. 20, 2017

(54) METHOD FOR AUDIO SIGNAL PROCESSING AND SYSTEM THEREOF

(71) Applicant: Peng Lee, New Taipei (TW)

(72) Inventor: Peng Lee, New Taipei (TW)

( * ) Notice: Subject to any disclaimer, the term of this patent is extended or adjusted under 35 U.S.C. 154(b) by 4 days.

(21) Appl. No.: 14/883,337

(22) Filed: Oct. 14, 2015

(65) Prior Publication Data

US 2017/0055080 A1 Feb. 23, 2017

(30) Foreign Application Priority Data

Aug. 17, 2015 (TW) ..... 104126752 A

(51) Int. Cl.
*H04R 5/04* (2006.01)
*H04R 3/04* (2006.01)

(52) U.S. Cl.
CPC ..... *H04R 5/04* (2013.01); *H04R 3/04* (2013.01); *H04R 2430/01* (2013.01); *H04R 2430/03* (2013.01)

(58) Field of Classification Search
None
See application file for complete search history.

(56) References Cited

U.S. PATENT DOCUMENTS 7,873,174 B2 * 1/2011 Yoshino ..... H04R 3/12 381/77
8,295,498 B2 * 10/2012 Karlsson ..... H04S 1/00 381/17
2004/0114770 A1 * 6/2004 Pompei ..... H04R 5/02 381/77
2005/0013442 A1 * 1/2005 Ohta ..... H04S 7/30 381/1
2007/0211574 A1 * 9/2007 Croft ..... G10K 15/02 367/197
2009/0180626 A1 * 7/2009 Nakano ..... H04S 3/00 381/17
2010/0054483 A1 * 3/2010 Mizuno ..... H04S 7/302 381/17
2011/0160883 A1 * 6/2011 Yasuda ..... H04R 3/14 700/94
2015/0382129 A1 * 12/2015 Florencio ..... H04S 7/303 381/303

* cited by examiner

*Primary Examiner* — Paul Huber
(74) *Attorney, Agent, or Firm* — Maschoff Brennan

(57) ABSTRACT

A method for audio signal processing and system thereof, the method includes the steps of: obtaining first audio signal information, obtaining second audio signal information, determining an audio parameter based on the first audio signal information and the second audio signal information, modulating the first audio signal information and the second audio signal information based on the audio parameter to generate a first outputting audio signal and a second outputting audio signal.

14 Claims, 4 Drawing Sheets

METHOD FOR AUDIO SIGNAL PROCESSING AND SYSTEM THEREOF

CROSS-REFERENCE TO RELATED APPLICATIONS

This non-provisional application claims priority under 35 U.S.C. §119(a) on Patent Application No. 104,126,752 filed in Taiwan, R.O.C. on Aug. 17, 2015, the entire contents of which are hereby incorporated by reference.

BACKGROUND

Technical Field

The present disclosure relates to a method for audio processing and a system thereof, particularly relates to a method for audio processing and a system thereof simulating a headphone.

Description of the Related Art

Using a headphone as an audio player brings users a great surround sound of user experiences. However, using the headphone for a long time may cause hearing damages. Therefore, the method of simulating a headphone with speakers is developed.

However, the method of simulating a headphone with speakers in the prior art is letting the user not to hear the sound of the right channel with the left ear and not to hear the sound of the left channel with the right ear. The surround sound of the headphone is poorly performed when simulating the headphone with speakers. Therefore, how to perform the directional information of the surround sound with speakers in the headphone simulation system is still a problem to be overcome.

SUMMARY

A method for audio signal processing for a system for audio signal processing includes obtaining a first sub-band audio of a first audio signal information, obtaining a second sub-band audio of a second audio signal information, determining an audio parameter according to the first sub-band audio and the second sub-band audio, and modulating the first audio signal information and the second audio signal information using the audio parameter to obtain a first outputting audio signal and a second outputting audio signal.

A system for audio signal processing includes a first filter, a second filter, an audio amplifier, an audio modulator, and an audio player. The first filter is for filtering a first audio signal information to obtain a first low frequency audio of the first audio signal information and a first sub audio of the first audio signal information, and the first sub audio and the first low frequency audio from the first audio signal information. The second filter is for filtering the second audio signal information to obtain a second low frequency audio of the second audio signal information and a second sub audio of the second audio signal information, and the second sub audio and the second low frequency audio form the second audio signal information. The audio amplifier is coupled to the first filter and the second filter, and is for determining an audio amplifying parameter according to the first sub audio and the second sub audio and amplifying the first sub audio and the second sub audio using the audio amplifying parameter. The audio modulator is coupled to the first filter, the second filter, and the audio amplifier respectively, and is for generating a first outputting audio signal and a second outputting audio signal according to the first low frequency audio, the second low frequency audio, the amplified first sub audio, and the amplified second sub audio. The audio player is coupled to the audio modulator, and is for outputting the first outputting audio signal and the second outputting audio signal.

The method for audio signal processing of the present disclosure captures the medium frequency or medium high frequency audio from the first audio signal information of the first channel and the second audio signal information of the second channel respectively and accordingly adjusts and amplifies the medium frequency audio of the first audio signal information and the medium frequency audio of the second audio signal information to enrich the directional information of the outputted audio.

BRIEF DESCRIPTION OF THE DRAWINGS

The present disclosure will become more fully understood from the detailed description given herein below and the accompanying drawings, which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings. Due to the characteristic of digital signal processing (DSP) area, the devices and components of the present disclosure are implemented by software, firmware, and hardware to realize digital audio processing and playing.

Figure 1:
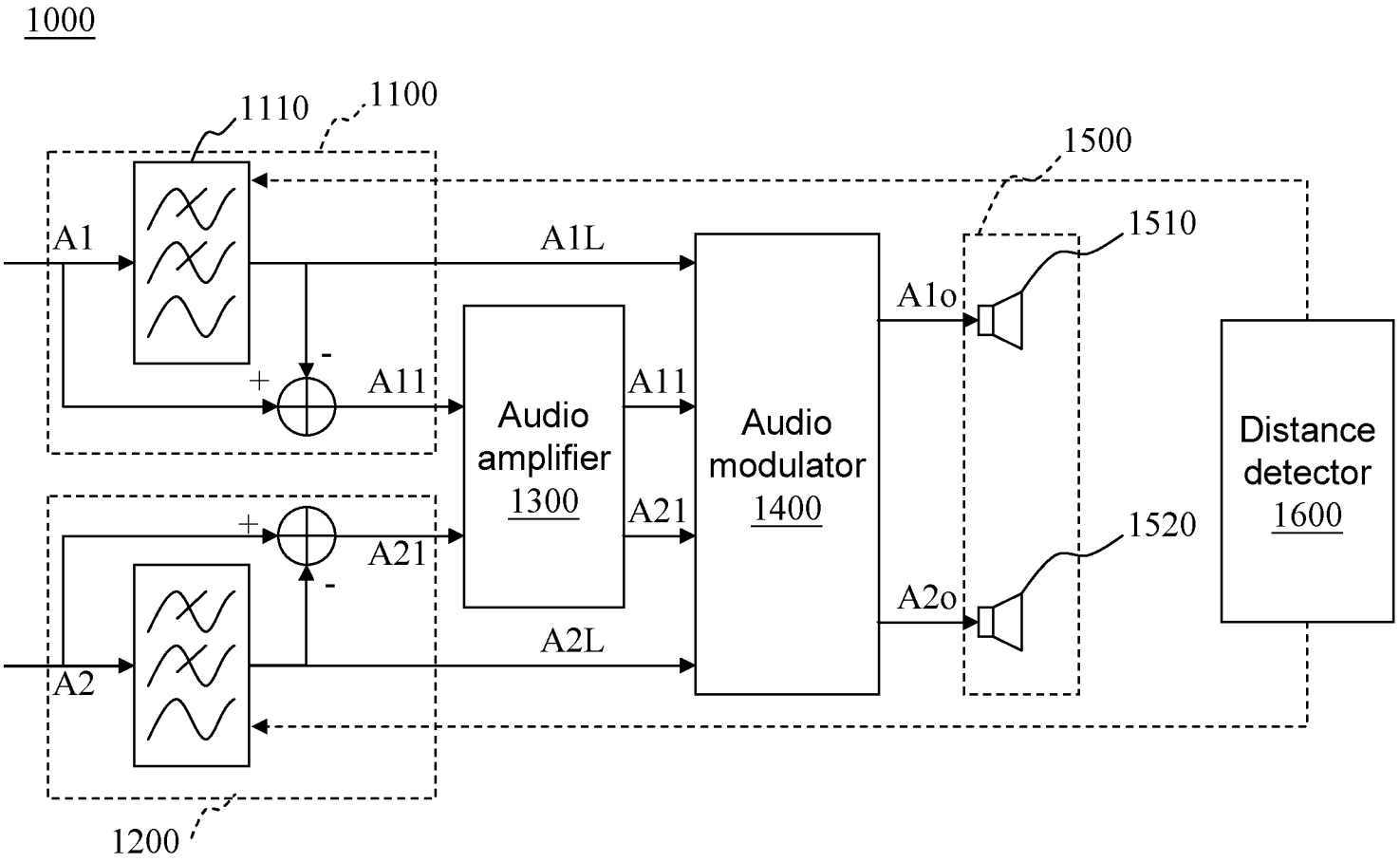
FIG. 1 is a structural diagram of the system for audio signal processing according to an embodiment.

Please refer to FIG. 1. FIG. 1 is a structural diagram of the system for audio signal processing according to an embodiment. As shown in FIG. 1, the system for audio signal processing 1000 includes a first filter 1100, a second filter 1200, an audio amplifier 1300, an audio modulator 1400, and an audio player 1500. The first filter 1100 and the second filter 1200 are both coupled to the audio amplifier 1300 and the audio modulator 1400. The audio amplifier 1300 is coupled to the audio modulator 1400. The audio modulator 1400 is coupled to the audio player 1500.

In an embodiment, please refer to FIG. 1. The first filter 1100 and the second filter 1200 both include a low-pass filter (LPF). Taking the first filter 1100 for example, the first low-pass filter 1110 of the first filter 1100 is for filtering the first audio signal information A1 from the first channel to obtain the low frequency audio A1L of the first audio signal information A1, and the first filter 1100 subtracts the low frequency audio A1L from the first audio signal information A1 to obtain the first sub audio A11. The second low-pass filter of the second filter 1200 is also for filtering the second audio signal information A2 from the second channel to obtain the low frequency audio A2L of the second audio signal information A2, and the second filter 1200 subtracts the low frequency audio A2L from the second audio signal information A2 to obtain the second sub audio A21. Therefore, in the present embodiment, the first sub audio A11 is the high frequency part of the first audio signal information A1 and the second sub audio A21 is the high frequency part of the second audio signal information A2.

Figure 2:
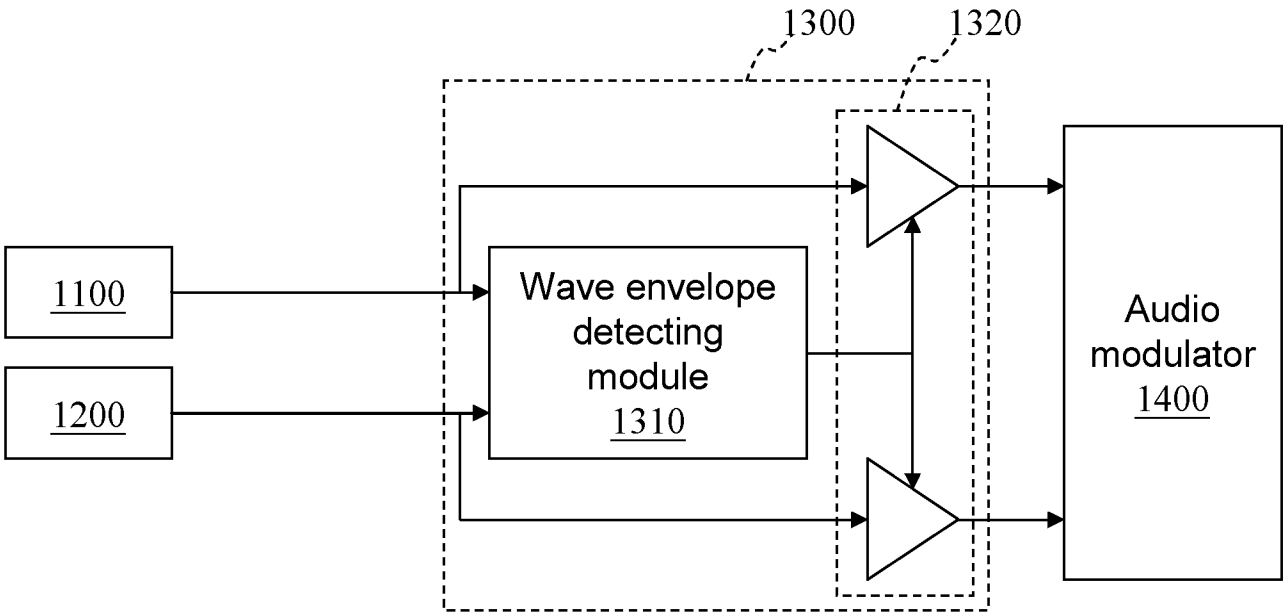
FIG. 2 is a structural diagram of the audio amplifier according to an embodiment.

The audio amplifier 1300 is for amplifying the first sub audio A11 and the second sub audio A21 according to the details of the first sub audio A11 and the second sub audio A21. Specifically, please refer to FIG. 2. FIG. 2 is a structural diagram of the audio amplifier according to an embodiment. As shown in FIG. 2, the audio amplifier 1300 includes a wave envelope detecting module 1310 and a controllable amplifying module 1320. The input terminal of the wave envelope detecting module 1310 is coupled to the first filter 1100 and the second filter 1200. The output terminal of the wave envelope detecting module 1310 is coupled to the controllable amplifying module 1320. The output terminal of the controllable amplifying module 1320 is coupled to the audio modulator 1400.

The wave envelope detecting module 1310 is for detecting the wave envelopes of the first sub audio A11 and the second sub audio A21, and for determining an audio amplifying parameter according to the wave envelopes of the first sub audio A11 and the second sub audio A21. In an embodiment, the wave envelope detecting module 1310 detects the first wave envelope of the first sub audio A11 and the second wave envelope of the second sub audio A21, and compares the level of the second sub audio A21 with the level of the second wave envelope, and determines the audio amplifying parameter according to the maximum level corresponding to the first wave envelope and the second wave envelope. More specifically, when the maximum level corresponding to the first wave envelope is greater than the maximum level corresponding to the second wave envelope, the wave envelope detecting module 1310 determines the audio amplifying parameter according to the maximum level corresponding to the first wave envelope. When the maximum level corresponding to the first wave envelope is not greater than the maximum level corresponding to the second wave envelope, the wave envelope detecting module 1310 determines the audio amplifying parameter according to the maximum level corresponding to the second wave envelope. The controllable amplifying module 1320 is for amplifying the first wave envelope of the first sub audio A11 and the second wave envelope of the second sub audio A21 according to the amplifying parameter.

The audio modulator 1400 is for mixing the high frequency audio A2H of the second audio signal information A2 and the amplified first sub audio A11 delaying for a first duration P1 with the low frequency audio A2L of the second audio signal information A2 and the amplified second sub audio A21 to generate a second outputting audio signal A2*o*. Similarly, the audio modulator 1400 mixes the high frequency audio A1H of the second audio signal information A1 and the amplified second sub audio A21 delaying for a first duration P1 with the low frequency audio A1L of the first audio signal information A1 and the amplified first sub audio A11 to generate a first outputting audio signal A1*o*.

The audio player 1500 includes a first channel speaker 1510 and a second channel speaker 1520. The first channel speaker 1510 and the second channel speaker 1520 are both coupled to the audio modulator 1400, and the first channel speaker 1510 is for outputting the first outputting audio signal A1*o* to an analog audio and the second channel speaker 1520 is for outputting the second outputting audio signal A2*o* to an analog audio.

Figure 3:
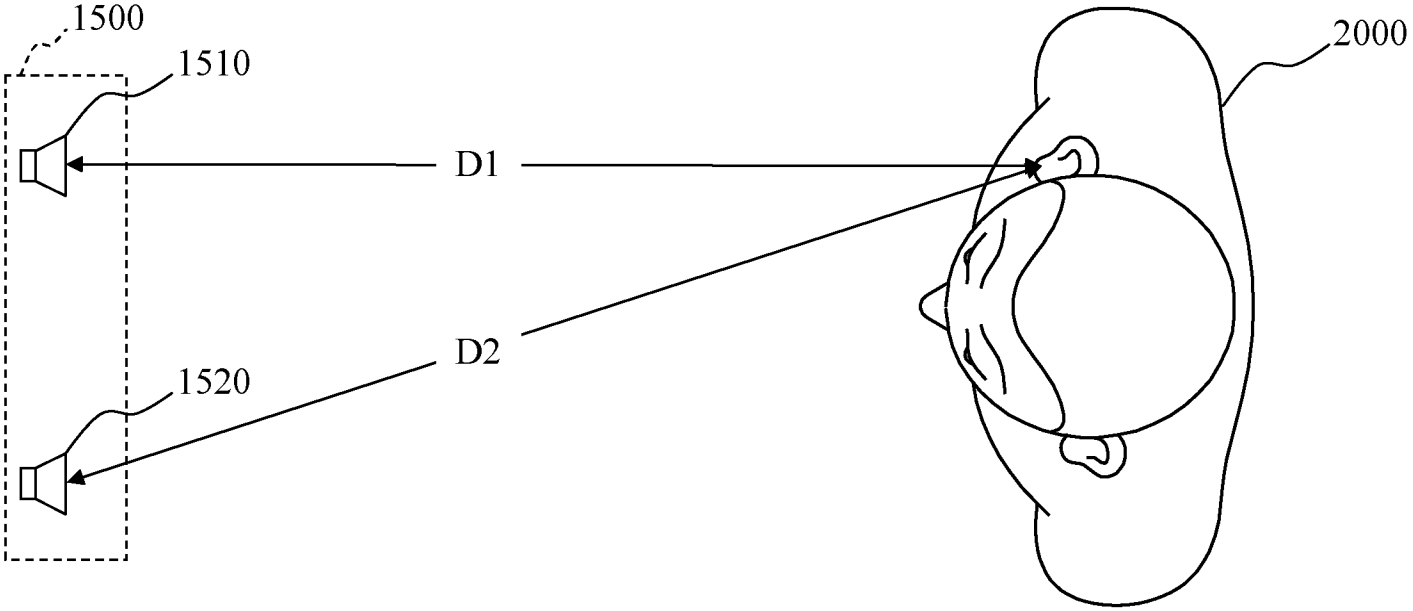
FIG. 3 is a practical usage diagram of the system for audio signal processing according to an embodiment.

Please refer to FIG. 3. FIG. 3 is a practical usage diagram of the system for audio signal processing according to an embodiment. As shown in FIG. 3, when a user 2000 is in front of the first channel speaker 1510 and the second channel speaker 1520, the user 2000 listens to the first outputting audio signal A1*o* outputted from the first channel speaker 1510 with the right ear, and listens to the second outputting audio signal A2*o* outputted from the second channel speaker 1520. As shown in FIG. 3, the distance D1 between the first channel speaker 1510 and the right ear is different from the distance D2 between the second channel speaker 1520 and the right ear, and the distance D2 is greater than the distance D1. Therefore, there is an interval difference between the first outputting audio signal A1*o* and the second outputting audio signal A2*o* when the right ear listens to the first outputting audio signal A1*o* and the second outputting audio signal A2*o*, and the time interval is exactly equal or approximate to the first duration P1, so that the part of the second audio signal information A2 in the first outputting audio signal A1*o* and the part of the second audio signal information A2 in the second outputting audio signal A2*o* are cancelled to each other. Therefore, although the user 2000 is not using a headphone, the right ear almost only receives the audio signal of the first sub audio A11 adjusted by the audio amplifier 1300 and the low frequency audio A1L of the first audio signal information A1. Due to the same principle, the left ear almost only receives the second sub audio A21 adjusted by the audio amplifier 1300 and the low frequency audio A2L of the second audio signal information A2.

In an embodiment, as the distance D1 and the distance D2 changes, adequate adjustment for amplifying or modulating the first audio signal information A1 and the second audio signal information A2 are needed for the user 2000 to obtain a better listening enjoyment. Please refer back to FIG. 1. The system for audio signal processing 1000 further includes a distance detector 1600. The distance detector 1600 is coupled to the audio amplifier 1300 and is for detecting the distance between the user 2000 and the first channel speaker 1510 and the distance between the user 2000 and the second channel speaker 1520. In an embodiment, the distance detector 1600 is a laser distance detector for detecting the distance between the user 2000 and the first channel speaker 1510. In another embodiment, the distance detector 1600 is a microphone on the user 2000 to receive the sound from the first channel speaker 1510 and the second channel speaker 1520 for determining the distance between the user 2000 and the first channel speaker 1510 and the distance between the user 2000 and the second channel speaker 1520 accordingly and sending the distances to the first filter 1100 and the second filter 1200. The first filter 1100 determines the frequency response according to the distance. The second filter 1200 determines the frequency response according to the distance. Taking the first filter 1100 for example, the first filter 1100 determines the gain or attenuation of the frequency band according to the distance D1, wherein the frequency band is low frequency, medium frequency, and/or high frequency.

The reason why the audio amplifier 1300 does not process the low frequency audio A1L of the first audio signal information A1 and the low frequency audio A2L of the second audio signal information A2 is that the sound with low frequency contains less directional information to human hearing system. Therefore, the audio amplifier 1300 only processes the medium high frequency audio signal, so that the user 2000 sufficiently obtains the directional information from the first outputting audio signal A1*o* and the second outputting audio signal A2*o*.

In some embodiments, the outputted frequency responses of the first channel speaker 1510 and the second channel speaker 1520 are not the same, so the frequency response of the first filter 1100 is correspondingly set according to the frequency response of the first channel speaker 1510 and the frequency response of the second filter 1200 is correspondingly set according to the frequency response of the second channel speaker 1520. The specific implementation is described as follows. The first audio signal information A1 and second audio signal information A2 are added with a white noise or a sweep tone and are outputted from the aforementioned system structure. The audio outputted from the two speakers is received by an audio receiver, such as a microphone.

The frequency response of the first filter 1100 and the frequency response of the second filter 1200 are adjusted accordingly until the audio outputted from the two speakers are the same.

Figure 4:
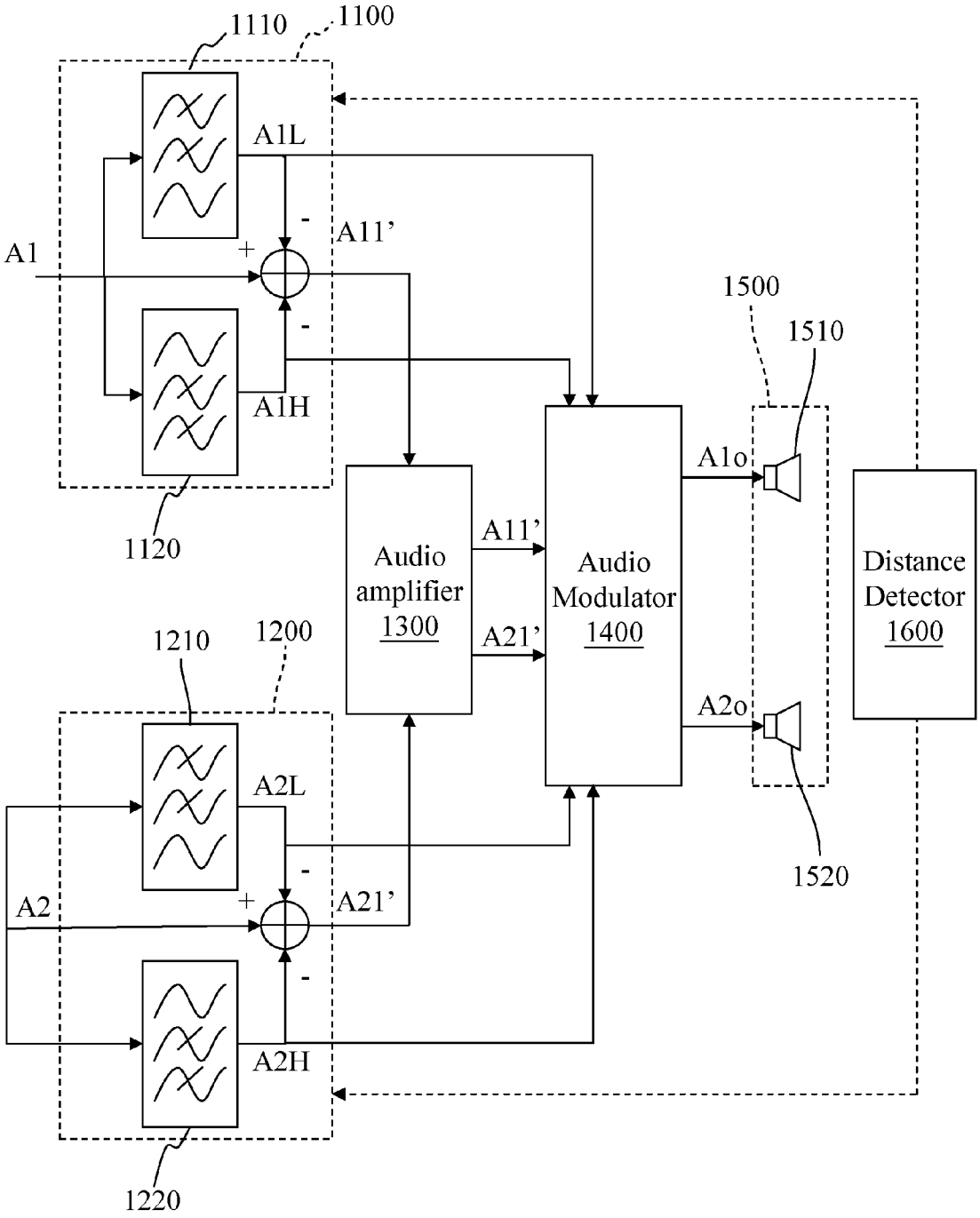
FIG. 4 is a functional block diagram of the first filter according to an embodiment.

In some other embodiments, please refer to FIG. 4. FIG. 4 is a functional block diagram of the first filter according to an embodiment. As shown in FIG. 4, the first filter 1100 includes a low-pass filter (LPF) and a high-pass filter (HPF). The first low-pass filter 1110 of the first filter 1100 is for filtering the first audio signal information A1 from the first channel to obtain the low frequency audio A1L of the first audio signal information A1. The first high-pass filter 1120 of the first filter 1100 is for filtering the first audio signal information A1 from the first channel to obtain the high frequency audio A1H of the first audio signal information A1. The first filter 1100 subtracts the low frequency audio A1L and the high frequency audio A1H from the first audio signal information A1 to obtain the first sub audio A11'. The second filter 1200 has the same structure, so that the second filter outputs the high frequency audio A2H, the low frequency audio A2L, and the second sub audio A21' of the second audio signal information A1. Therefore, taking the present embodiment for example, the first sub audio A11' is the medium frequency part of the first audio signal information A1 and the second sub audio A21' is the medium frequency part of the second audio signal information A2. The audio amplifier 1300 receives the first sub audio A11' and the second sub audio A21' and performs the aforementioned processing method of the present disclosure. The audio modulator 1400 directly receives the high frequency audio A1H and the low frequency audio A1L of the first audio signal information A1 from the first filter 1100, and directly receives the high frequency audio and the low frequency audio of the second audio signal information A2 from the second filter 1200. The audio modulator 1400 combines the audio from the first filter 1100 and the second filter 1200 with the first sub audio A11' and the second sub audio A12' processed by the audio amplifier 1300, and eventually outputs the first outputting audio signal A1*o* and the second outputting audio signal A2*o* after performing the aforementioned process.

The method for audio signal processing of the present disclosure captures the medium frequency or medium high frequency audio from the first audio signal information of the first channel and the second audio signal information of the second channel respectively and accordingly adjusts and amplifies the medium frequency audio of the first audio signal information and the medium frequency audio of the second audio signal information to enrich the directional information of the outputted audio.

The foregoing description has been presented for purposes of illustration. It is not exhaustive and does not limit the disclosure to the precise forms or embodiments disclosed. Modifications and adaptations will be apparent to those skilled in the art from consideration of the specification and practice of the disclosed embodiments of the disclosure. It is intended, therefore, that the specification and examples be considered as exemplary only, with a true scope and spirit of the disclosure being indicated by the following claims and their full scope of equivalents.

What is claimed is:

1. A method for audio frequency signal processing for a system for audio signal processing, comprising:

obtaining a first sub-band audio of a first audio signal information;

obtaining a second sub-band audio of a second audio signal information;

determining an audio parameter according to the first sub-band audio and the second sub-band audio; and modulating the first audio signal information and the second audio signal information which have been processed using the audio parameter to obtain a first outputting audio signal and a second outputting audio signal.

2. The method of claim 1, wherein the step of determining an audio parameter according to the first sub-band audio and the second sub-band audio comprises:

comparing the first sub-band audio with the second sub-band audio;

when a level of the first sub-band audio is greater than a level of second sub-band audio, determining the audio parameter according to the level of the first sub-band audio; and when the level of the first sub-band audio is not greater than the level of second sub-band audio, determining the audio parameter according to the level of the second sub-band audio.

3. The method of claim 2, wherein the step of comparing the first sub-band audio with the second sub-band audio comprises:

obtaining a first wave envelope of the first sub-band audio;

obtaining a second wave envelope of the second sub-band audio; and comparing a peak level of the first wave envelope and a peak level of the second wave envelope.

4. The method of claim 1, wherein the step of obtaining the first sub-band audio comprises:

capturing a low frequency audio of the first audio signal information using a first low-pass filter; and subtracting the low frequency audio of the first audio signal information from the first audio signal information to obtain the first sub-band audio.

5. The method of claim 4, wherein the step of obtaining the first sub-band audio further comprises:

capturing a high frequency audio of the first audio signal information using a first high-pass filter;

wherein the step of obtaining the first sub-band audio further comprises subtracting the high frequency audio of the first audio signal information from the first audio signal information to obtain the first sub-band audio.

6. The method of claim 4, wherein the system for audio signal processing comprises a first channel speaker to play the first outputting audio signal and the frequency response of the first low-pass filter corresponds to the frequency response of the first channel speaker.

7. The method of claim 1, wherein the system for audio signal processing comprises a distance detector to detect a distance between a user and the system for audio signal processing, and the step of obtaining a first sub-band audio of a first audio signal information further comprises obtaining a first sub-band audio using a gain or an attenuation according to the distance.

8. A system for audio signal processing, comprising:

a first filter for filtering a first audio signal information to obtain a first low frequency audio of the first audio signal information and a first sub audio of the first audio signal information, the first sub audio and the first low frequency audio forming the first audio signal information;

a second filter for filtering a second audio signal information to obtain a second low frequency audio of the second audio signal information and a second sub audio of the second audio signal information, the second sub audio and the second low frequency audio forming the second audio signal information;

an audio amplifier coupled to the first filter and the second filter, for determining an audio amplifying parameter according to the first sub audio and the second sub audio and amplifying the first sub audio and the second sub audio using the audio amplifying parameter;

an audio modulator coupled to the first filter, the second filter, and the audio amplifier respectively, for generating a first outputting audio signal and a second outputting audio signal according to the first low frequency audio, the second low frequency audio, the amplified first sub audio, and the amplified second sub audio; and an audio player coupled to the audio modulator, for outputting the first outputting audio signal and the second outputting audio signal.

9. The system of claim 8, wherein the first filter comprises:

a first low-pass filter for generating the first low frequency audio according to the received first audio signal information; and a subtractor coupled to the first low-pass filter, for subtracting the first low frequency audio from the first audio signal information to generate the first sub audio.

10. The system of claim 9, wherein the first filter further comprises:

a high-pass filter for generating a first high frequency audio according to the first audio signal information;

wherein when the subtractor generates the first sub audio, the first low frequency audio and the first high frequency audio are subtracted from the first audio signal information to generate the first sub audio.

11. The system of claim 8, wherein the audio amplifier comprises:

a wave envelope detecting module coupled to the first filter and the second filter, for detecting a first wave envelope of the first sub audio, detecting a second wave envelope of the second sub audio, and comparing a level of the first wave envelope with a level of the second wave envelope to determine the audio amplifying parameter correspondingly; and a controllable amplifying module coupled to the wave envelope detecting module, the first filter, and the second filter, for amplifying the first sub audio and the second sub audio according to the audio amplifying parameter.

12. The system of claim 8, further comprising a distance detector communication connected to the first filter and the second filter, the distance detector for detecting a distance between a user and the system for audio signal processing, and the first filter and the second filter adjusting the frequency response respectively according to the distance.

13. The system of claim 12, wherein the distance detector is an audio receiver on the user for receiving a sound of the first outputting audio signal, a sound of the second outputting audio signal, an electrical signal of the first outputting audio signal, and an electrical signal of the second outputting audio signal, and for calculating the distance accordingly.

14. The system of claim 8, wherein the audio player comprises:

a first channel speaker coupled to the audio modulator, for outputting sound with the first outputting audio signal; and a second channel speaker coupled to the audio modulator, for outputting sound with the second outputting audio signal;

wherein the frequency response of the first filter corresponds to the frequency response of the first channel speaker and the frequency response of the second filter corresponds to the frequency response of the second channel speaker.

* * * * *